US009499997B1

(12) United States Patent
Kelly

(10) Patent No.: US 9,499,997 B1
(45) Date of Patent: Nov. 22, 2016

(54) POOL WATER SURFACE SCREENING DEVICE

(76) Inventor: Robert T. Kelly, Tampa, FL (US)

( * ) Notice: Subject to any disclaimer, the term of this patent is extended or adjusted under 35 U.S.C. 154(b) by 946 days.

(21) Appl. No.: 13/374,405

(22) Filed: Dec. 28, 2011

(51) Int. Cl.
*E04H 4/16* (2006.01)

(52) U.S. Cl.
CPC ..... *E04H 4/16* (2013.01)

(58) Field of Classification Search
CPC ..... E04H 4/16
USPC ..... 210/167.19, 167.2, 242.1
See application file for complete search history.

(56) References Cited

U.S. PATENT DOCUMENTS 5,264,122 A * 11/1993 Lakotish ..... 210/167.2
5,849,184 A * 12/1998 Veillet ..... E04H 4/1254 210/167.2
5,911,878 A * 6/1999 Benvenuto ..... E04H 4/1263 210/167.2
6,270,683 B1 * 8/2001 Turner ..... E04H 4/1254 210/167.2
7,033,490 B2 * 4/2006 Blackman ..... E04H 4/1609 210/167.2
7,455,767 B2 * 11/2008 Pamperin ..... 210/167.2

* cited by examiner

*Primary Examiner* — Fred Prince
(74) *Attorney, Agent, or Firm* — Edward P. Dutkiewicz

(57) ABSTRACT

A pool water surface screening device comprising, in combination, a fixed arm having a hollow tubular configuration forming a fixed arm passageway through the fixed arm, a net holder being coupled to the fixed arm, a swing arm having a passageway therethrough, with the swing arm being coupled to the net holder, and a net.

10 Claims, 4 Drawing Sheets

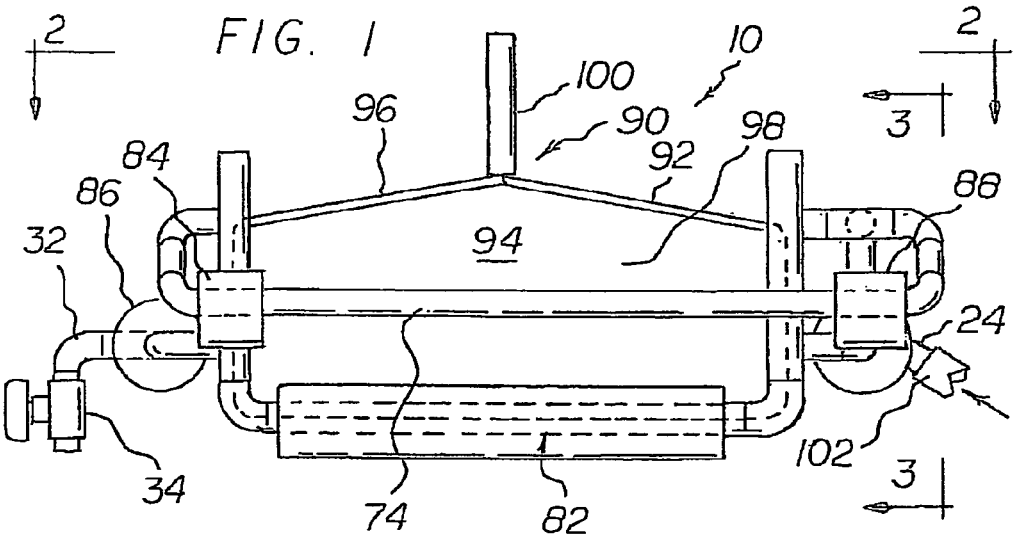
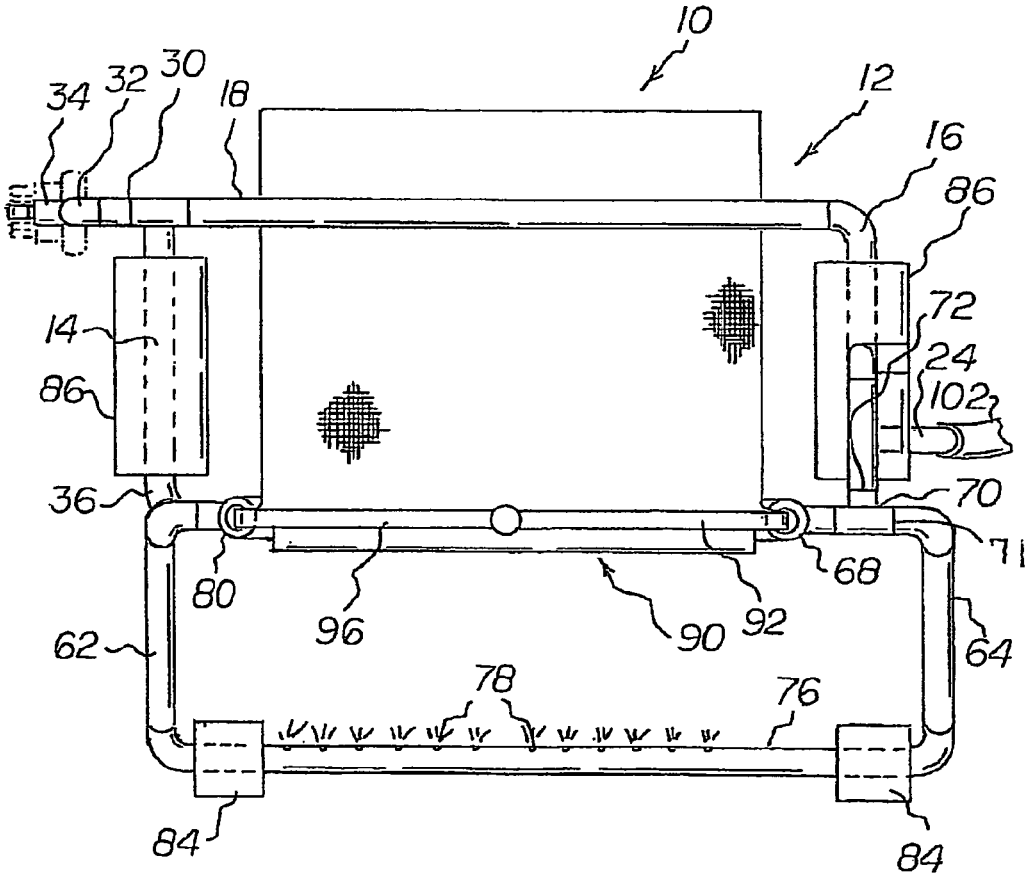
FIG. 2

FIG. 3
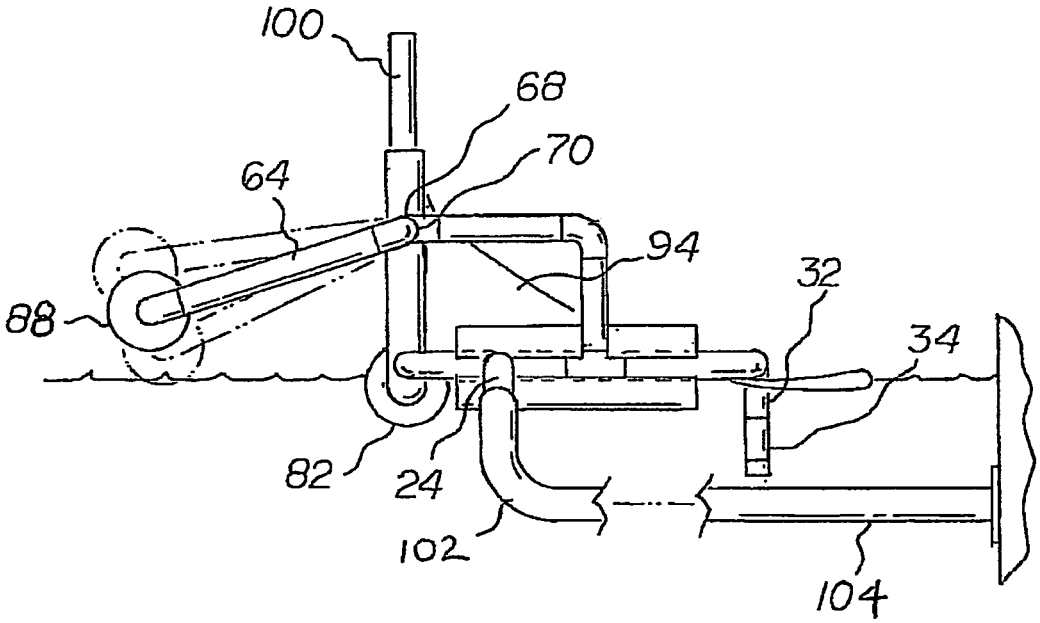
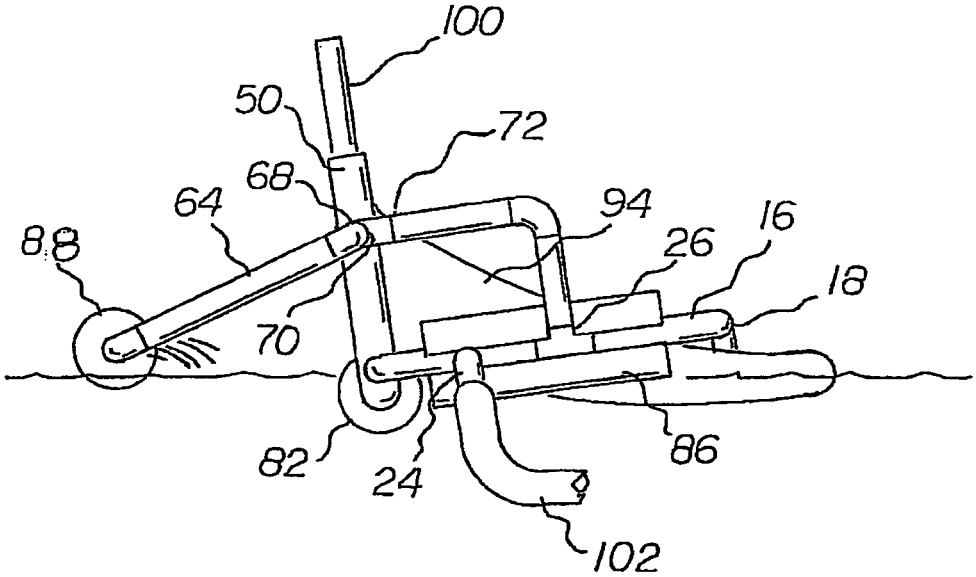
FIG. 4

FIG. 5
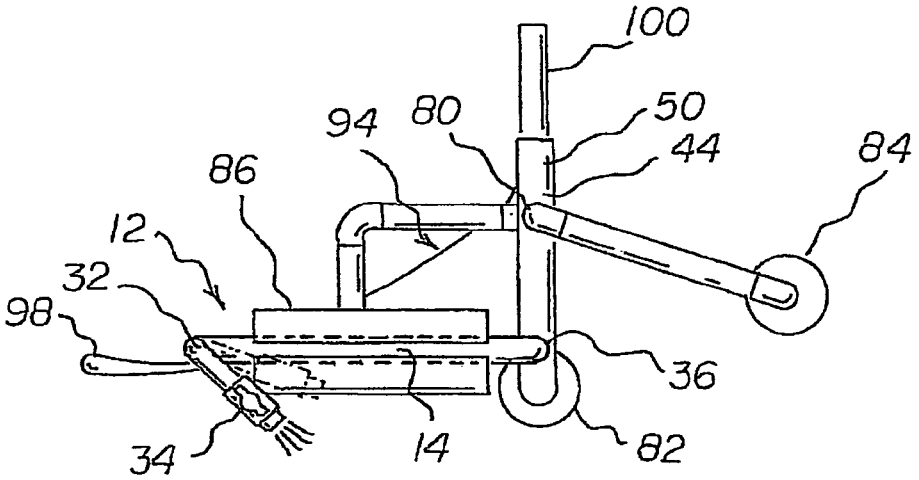
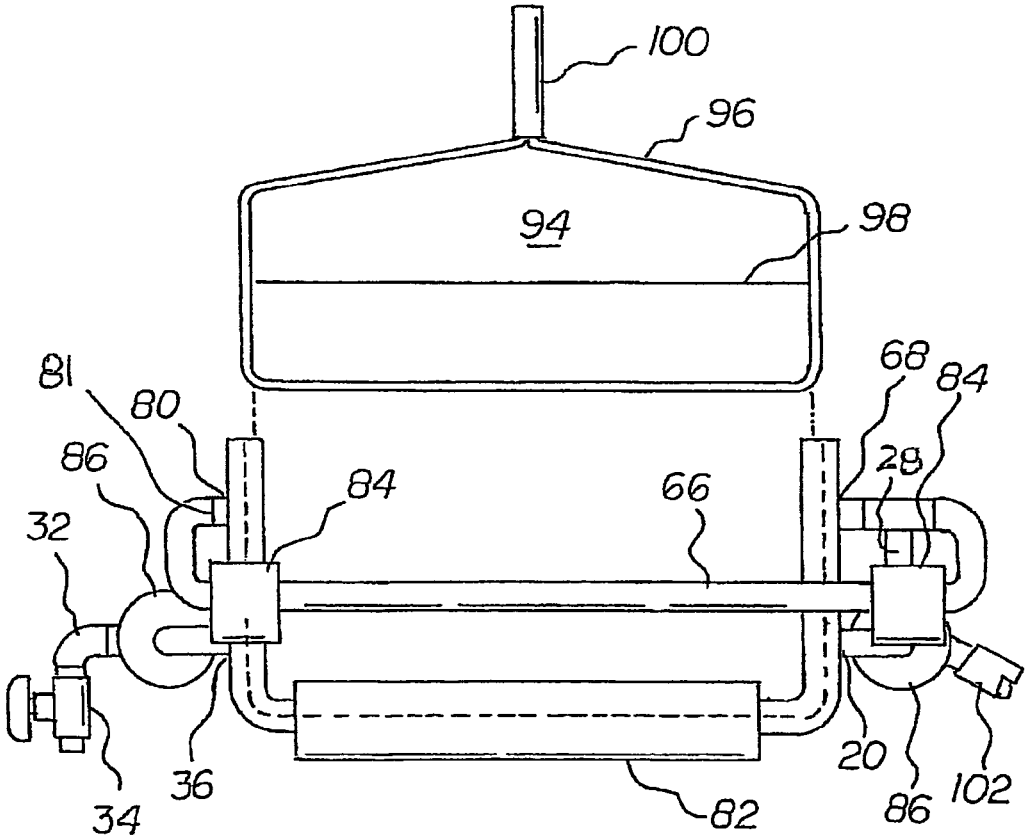
FIG. 6

POOL WATER SURFACE SCREENING DEVICE

BACKGROUND OF THE INVENTION

1. Rule 1.78(F)(1) Disclosure

The Applicant has not submitted a related pending or patented non-provisional application within two months of the filing date of this present application. The invention is made by a single inventor, so there are no other inventors to be disclosed. This application is not under assignment to any other person or entity at this time.

2. Field of the Invention

The present invention relates to a pool water surface screening device and more particularly pertains to a novel way of screening debris from the surface of a swimming pool.

3. Description of the Prior Art

The use of swimming pool screens is known in the prior art. More specifically, swimming pool screens previously devised and utilized for the purpose of cleaning debris from the surface of a swimming pool are known to consist basically of familiar, expected, and obvious structural configurations, notwithstanding the myriad of designs encompassed by the prior art which has been developed for the fulfillment of countless objectives and requirements.

While the prior art devices fulfill their respective, particular objectives and requirements, the prior art does not describe a pool water surface screening device that allows a novel way of screening debris from the surface of a swimming pool.

In this respect, the pool water surface screening device according to the present invention substantially departs from the conventional concepts and designs of the prior art, and in doing so provides an apparatus primarily developed for the purpose of providing a novel way of screening debris from the surface of a swimming pool.

Therefore, it can be appreciated that there exists a continuing need for a new and improved pool water screening device which can be used for cleaning debris from the surface of a swimming pool. In this regard, the present invention substantially fulfills this need.

SUMMARY OF THE INVENTION

In view of the foregoing disadvantages inherent in the known types of swimming pool screens now present in the prior art, the present invention provides an improved pool water surface screening device. As such, the general purpose of the present invention, which will be described subsequently in greater detail, is to provide a new and improved pool water surface screening device which has all the advantages of the prior art and none of the disadvantages.

To attain this, the present invention essentially comprises a pool water surface screening device comprising several components, in combination.

First there is a fixed arm. The fixed arm is fabricated of a generally rigid material. The fixed arm has a hollow tubular C-shaped configuration, forming a fixed arm passageway through the fixed arm. The fixed arm has a right portion, a left portion, and a rearward portion, with the passageway through the fixed arm being continuous through the right portion, the rearward portion, and the left portion.

The left portion of the fixed arm has a forward terminus, with the left portion forward terminus being closed. The left portion has an inflow pipe hole and an associated inflow pipe which is coupled to the inflow pipe hole. The inflow pipe has a hollow tubular configuration forming an inflow pipe passageway through the inflow pipe. The inflow pipe passageway is continuous with the fixed arm passageway.

The left portion of the fixed arm has a connecting tube hole and an associated connecting tube coupled thereto. The connecting tube has a hollow tubular configuration, forming a connecting tube passageway therethrough. The connecting tube passageway is continuous with the fixed arm passageway.

The right portion of the fixed arm has a down pipe hole and an associated down pipe rotatably coupled thereto. The down pipe has a hollow tubular configuration with a passageway there through. The down pipe has a flow regulator/bleed-out valve operatively coupled thereto.

The right portion of the fixed arm has a forward terminus, with the right portion forward terminus being closed.

There is next a net holder, which is part of the fixed arm. The net holder is fabricated of a generally rigid material. The net holder has a generally C-shaped configuration with a lower portion and two generally mirror image side portions, being a right side portion and a left side portion. The upper extent of the net holder is open.

The lower portion of the net holder, the right side portion of the net holder and the left side portion of the net holder each have a generally C-shaped configuration, with an outwardly disposed wall.

The generally C-shaped configuration of the lower portion of the net holder, the right side portion of the net holder and the left side portion of the net holder, each have an inwardly oriented recess therein, with the recess having a first width. Each of the side portions have an upper section, a lower section, and an intermediate section, with the intermediate section being between the upper section and the lower section.

The terminus of the left portion of the fixed arm is coupled to the lower section of the left side portion of the net holder. The terminus of the right portion of the fixed arm is coupled to the lower section of the right side portion of the net holder.

Next there is a swing arm, which is attached to the fixed arm at the flexible joints. The swing arm is fabricated of a generally rigid material. The swing arm has a hollow tubular configuration, forming a swing arm passageway through the swing arm. The swing arm has a right portion, a left portion, and a forward portion, with the passageway through the swing arm being continuous through the right portion of the swing arm, the forward portion of the swing arm, and the left portion of the swing arm.

The left portion of the swing arm has a rearward terminus. The swing arm left portion rearward terminus is closed. The swing arm left portion rearward terminus is rotatable at the flexible joint and is coupled to the outward wall of the left side portion of the net holder. The swing arm left portion has a connecting tube hole and an associated connecting joint. The connecting joint has a hollow tubular configuration with a passageway therethrough. The connecting joint has a flexible joint which connects to the swing arm. The connecting joint operatively couples the swing arm, the fixed arm and the connecting tube, thereby forming a continuous passageway between the fixed arm, the swing arm, the connecting joint and the connecting tube.

The forward portion of the swing arm has a forward surface and a rearward surface, with the rearward surface of the forward portion of the swing arm having a plurality of jet holes therein. The forward portion of the swing arm is rotatable between the right portion of the swing arm and the left portion of the swing arm. The right portion of the swing arm has a rearward terminus. The swing arm right portion rearward terminus is closed. The right portion rearward terminus is connected to the outward wall of the right side portion of the net holder and rotatably coupled to the swing arm at the flexible joint.

Next there is a net holder float. The net holder float is operatively coupled to the net holder, providing buoyancy to the net holder.

Next there is a pair of similarly configured swing arm floats. Each swing arm float is operatively coupled to the swing arm. Each swing arm float is located adjacent the plurality of swing arm jet holes.

Next there is a pair of fixed arm floats. Each fixed arm float is operatively coupled to the fixed arm. One fixed arm float is located on the right portion of the fixed arm and one fixed arm float is located on the left portion of the fixed arm.

Next there is a net. The net has a frame, with the net frame being fabricated of a generally rigid material. The net has a generally tapered and continuous screen. The net frame has a second width, with the first width of the net holder being greater than the second width of the net frame, allowing the net frame to be received by and held in place by, the net holder. The net screen has a forward edge and a rearwardly oriented recess. The net screen forward edge is coupled to the net frame, with the net frame having a gripping portion and the rearwardly oriented recess being free.

Lastly, there is a liquid source, such as a swimming pool pump or fountain pump. The liquid source pump moves the liquid. The liquid source is coupled to the inflow pipe of the fixed arm by a flexible hose. Attached to the end of the flexible hose is a configured rigid tube section that is inserted into the outflow fitting of the pool.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pool water surface screening device which has all of the advantages of the prior art swimming pool screens and none of the disadvantages.

It is another object of the present invention to provide a new and improved pool water surface screening device which may be easily and efficiently manufactured and marketed.

It is further object of the present invention to provide a new and improved pool water surface screening device which is of durable and reliable constructions.

An even further object of the present invention is to provide a new and improved pool water surface screening device which is susceptible of a low cost of manufacture with regard to both materials and labor, and which accordingly is then susceptible of low prices of sale to the consuming public, thereby making such pool water surface screening device economically available to the buying public.

Even still another object of the present invention is to provide a pool water surface screening device for providing a novel way of screening debris from the surface of a swimming pool.

Lastly, it is an object of the present invention to provide a new and improved pool water surface screening device comprising, in combination, a fixed arm having a hollow tubular configuration forming a fixed arm passageway through the fixed arm, a net holder being coupled to the fixed arm, a swing arm having a passageway therethrough, with the swing arm being coupled to the net holder, and a net.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is front elevational view of the pool screen device.

FIG. 2 is a view of the device taken along line 2-2 of FIG. 1.

FIG. 3 is a view of the device taken along line 3-3 of FIG. 1.

FIG. 4 is a left side elevational view of the device, showing the water jets moving the water through the net. Note that the floats provide buoyancy for the device, including the swing arm, the net holder, and the fixed arm.

FIG. 5 is a right side elevational view showing the rotatable bleed valve.

FIG. 6 is a front elevational view showing the net being removed from the net holder. Note that the net frame slides into the net holder recess.

The same reference numerals refer to the same parts throughout the various Figures.

DESCRIPTION OF THE PREFERRED EMBODIMENT

Figure 7:
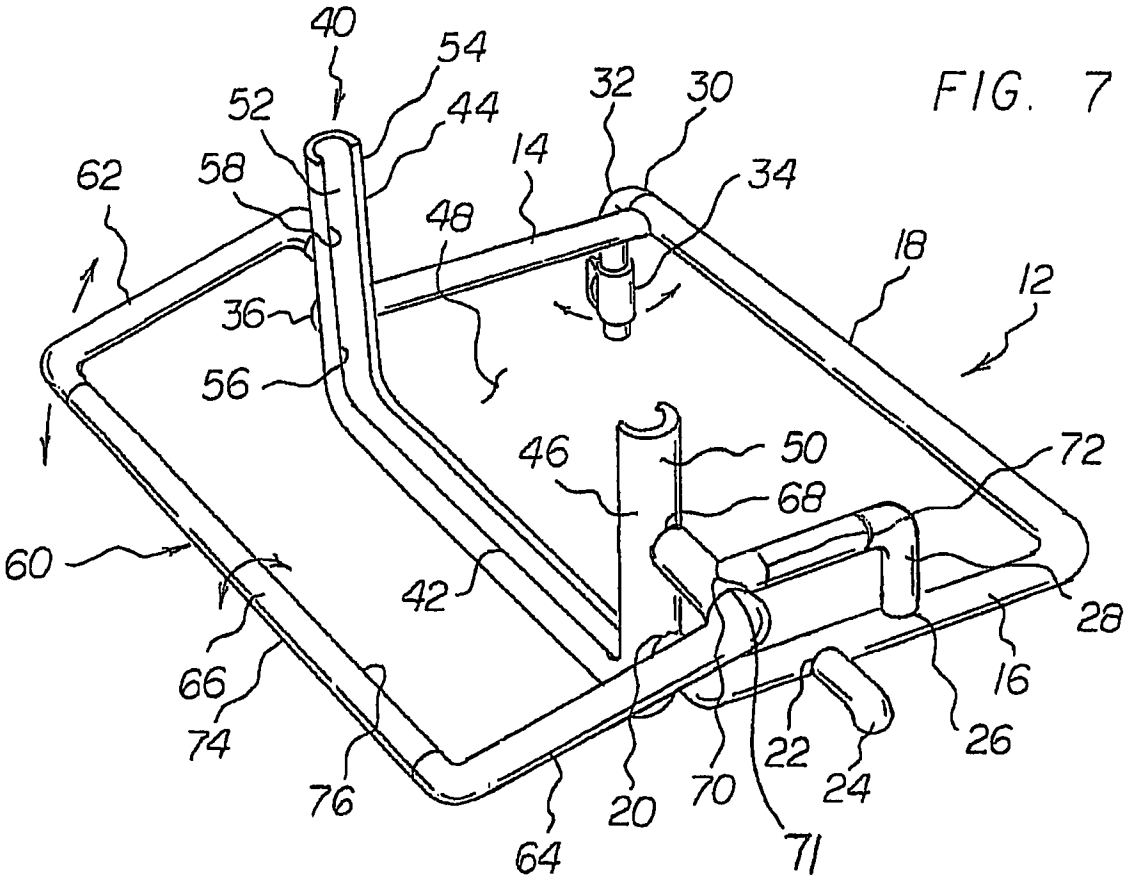
FIG. 7 is a skeleton view of the device showing the fixed arm, the net holder, and the swing arm. Note the inflow pipe, the connecting tube, the down pipe and the bleed out valve.

With reference now to the drawings, and in particular to FIG. 1 thereof, the preferred embodiment of the new and improved pool water surface screening device embodying the principles and concepts of the present invention and generally designated by the reference numeral 10 will be described.

The present invention, the pool water surface screening device 10 is comprised of a plurality of components. Such components in their broadest context include a fixed arm, a net holder, a swing arm and a net. Such components are individually configured and correlated with respect to each other so as to attain the desired objective.

First there is a fixed arm 12. The fixed arm is fabricated of a generally rigid material. The fixed arm has a hollow tubular C-shaped configuration, forming a fixed arm passageway through the fixed arm. The fixed arm has a right portion 14, a left portion 16, and a rearward portion 18, with the passageway through the fixed arm being continuous through the right portion, the rearward portion, and the left portion.

The left portion of the fixed arm has a forward terminus 20, with the left portion forward terminus being closed. The left portion has an inflow pipe hole 22 and an associated inflow pipe 24 which is coupled to the inflow pipe hole. The inflow pipe has a hollow tubular configuration forming an inflow pipe passageway through the inflow pipe. The inflow pipe passageway is continuous with the fixed arm passageway.

The left portion of the fixed arm has a connecting tube hole 26 and an associated connecting tube 28 coupled thereto. The connecting tube has a hollow tubular configuration, forming a connecting tube passageway therethrough. The connecting tube passageway is continuous with the fixed arm passageway.

The right portion of the fixed arm has a down pipe hole 30 and an associated down pipe 32 rotatably coupled thereto. The down pipe has a hollow tubular configuration with a passageway there through. The down pipe has a flow regulator/bleed-out valve 34 operatively coupled thereto.

The right portion of the fixed arm has a forward terminus 36, with the right portion forward terminus being closed.

There is next a net holder 40, which is part of the fixed arm. The net holder is fabricated of a generally rigid material. The net holder has a generally C-shaped configuration with a lower portion 42 and two generally mirror image side portions, being a right side portion 44 and a left side portion 46. The upper extent 48 of the net holder is open.

The lower portion of the net holder, the right side portion of the net holder, and the left side portion of the net holder each have a generally C-shaped configuration, with an outwardly disposed wall 50.

The generally C-shaped configuration of the lower portion of the net holder, the right side portion of the net holder, and the left side portion of the net holder each have an inwardly oriented recess 52 therein, with the recess having a first width. Each of the side portions have an upper section 54, a lower section 56, and an intermediate section 58, with the intermediate section being between the upper section and the lower section.

The terminus of the left portion of the fixed arm is coupled to the lower section of the left side portion of the net holder. The terminus of the right portion of the fixed arm is coupled to the lower section of the right side portion of the net holder.

Next there is a swing arm 60, which is attached to the fixed arm at the flexible joints. The swing arm is fabricated of a generally rigid material. The swing arm, attached to the fixed arm has a hollow tubular configuration, forming a swing arm passageway through the swing arm. The swing arm has a right portion 62, a left portion 64, and a forward portion 66, with the passageway through the swing arm being continuous through the right portion of the swing arm, the forward portion of the swing arm, and the left portion of the swing arm.

The left portion of the swing arm has a rearward terminus 68. The swing arm left portion rearward terminus is closed. The swing arm left portion rearward terminus is rotatable at the flexible joint 71 and is coupled to the outward wall of the left side portion of the net holder. The swing arm left portion has a connecting tube hole 70 and an associated connecting joint 72. The connecting joint has a hollow tubular configuration with a passageway therethrough. The connecting joint has a flexible joint which connects to the swing arm. The connecting joint operatively couples the swing arm, the fixed arm and the connecting tube 28, thereby forming a continuous passageway between the fixed arm, the swing arm, the connecting joint 72 and the connecting tube 28.

The forward portion of the swing arm has a forward surface 74 and a rearward surface 76, with the rearward surface of the forward portion of the swing arm having a plurality of jet holes 78 therein. The forward portion of the swing arm is rotatable between the right portion of the swing arm and the left portion of the swing arm.

The right portion of the swing arm has a rearward terminus 80. The swing arm right portion rearward terminus is closed. The right portion rearward terminus is connected to the intermediate section of the outward wall of the right side portion of the net holder and rotatably coupled to the swing arm at the flexible joint 81.

Next there is a net holder float 82. The net holder float is operatively coupled to the net holder, and provide buoyancy to the net holder.

Next there is a pair of similarly configured swing arm floats 84, 88. Each swing arm float is operatively coupled to the swing arm. Each swing arm float is located adjacent the plurality of swing arm jet holes.

Next there is a pair of fixed arm floats 86. Each fixed arm float is operatively coupled to the fixed arm. One fixed arm float is located on the right portion of the fixed arm and one fixed arm float is located on the left portion of the fixed arm.

Next there is a net 90. The net has a frame 92, with the net frame being fabricated of a generally rigid material. The net has a generally tapered and continuous screen 94. The net frame has a second width, with the first width of the net holder being greater than the second width of the net frame, allowing the net frame to be received by and held in place by, the net holder. The net screen has a forward edge 96 and a rearwardly oriented recess 98. The net screen forward edge is coupled to the net frame, with the net frame having a gripping portion 100 and the rearwardly oriented recess being free.

Lastly, there is a liquid source, such as a swimming pool pump or fountain pump (not shown, but well known in the art). The liquid source pump moves the liquid. The liquid source is coupled to the inflow pipe of the fixed arm by a flexible hose 102. Attached to the end of the flexible hose is a configured rigid tube section 104 that is inserted into the outflow fitting of the pool.

As can be seen in FIGS. 3 and 4, the device rests on the liquid surface. In the preferred embodiment, the liquid is water, as found in a swimming pool. The inflow is connected to the outflow of the pool pump. The water is forced, under pump pressure, through the rigid tube section, the flexible hose, the inflow pipe and into the fixed arm, through the connecting tube, the connecting joint 72 and into the swing arm. The swing arm is rotatable at the flexible joint and is positioned on the water's surface, and held in position by the swing arm floats. The water, under pressure, exits from the swing arm and strikes the pool water surface, forcing the water away from the swing arm, and into the opening of the net, as defined by the net frame. The position of the pool water surface screening device can be adjusted by use of the flow regulator/bleed-off valve, so as to provide an optimal functioning position of the device by controlling the pressure of the liquid source through the down pipe and flow regulator/bleed-out valve. The net is removable from the net holder, allowing a user to clean the net of debris from time to time. The advantage of the device is that the jetting of the water moves the water through the net, as opposed with other screening devices, which move the net through the water. This device, therefore, does not require lengths of hose which are required with the moving devices.

As can be seen in FIG. 3, the lower portion of the net holder rest above the surface of the water, when the liquid source is not flowing through the device, preventing debris from escaping from the net back into the pool.

As can be seen in FIG. 4, the lower portion of the net holder drops down below the surface of the water when the liquid source is flowing through the device due to the weight of the liquid source flowing through the swing arm and allowing the liquid source to flow, unrestricted, into the net.

As can be seen in FIG. 3, when the flow of the liquid source is terminated the liquid source contained in the swing arm, connecting joint, connecting tube, right portion, left portion and rearward portion bleeds-out through the down pipe, flow regulator/bleed-out valve and the plurality of swing arm jet holes, allowing the lower portion of the net holder to rest above the surface of the water, preventing the debris from escaping from the net back into the pool.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pool water screen device comprising, in combination:

a fixed arm having a hollow tubular configuration forming a fixed arm passageway through the fixed arm;

a net holder being coupled to the fixed arm;

a swing arm being coupled to the net holder, the swing arm having a passageway therethrough;

a net having a frame and a generally tapered and continuous screen, the screen being coupled to the net frame and the net frame being coupled to the net holder;

the fixed arm having a right portion and a left portion and a rearward portion with the fixed arm passageway being continuous through the fixed arm right portion and the fixed arm rearward portion and the fixed arm left portion;

the net holder having a lower portion having an outward wall and two side portions with each net holder side portion having an outward wall, with the net holder side portions being a net holder right side portion and a net holder left side portion, the upper extent of the net holder being open, each of the net holder side portions having an upper section and a lower section with an intermediate section there between; and the swing arm having a right portion and a left portion and a forward portion, with the swing arm passageway being continuous through the right portion of the swing arm and the forward portion of the swing arm and the left portion of the swing arm, the swing arm being coupled to the net holder.

2. The pool water screen device as described in claim 1, with the device further comprising:

the fixed arm left portion having an inflow pipe hole and an associated inflow pipe coupled to the inflow pipe hole, the inflow pipe having a hollow tubular configuration forming an inflow pipe passageway through the inflow pipe, the inflow pipe passageway being continuous with the fixed arm passageway; and the swing arm having a hollow tubular forming the swing arm passageway through the swing arm.

3. The pool water screen device as described in claim 2, with the device further comprising:

the fixed arm left portion having a connecting tube hole and an associated connecting tube coupled thereto, the connecting tube having a hollow tubular configuration forming a connecting tube passageway therethrough, the connecting tube passageway being continuous with the fixed arm passageway; and the swing arm left portion having a rearward terminus, the swing arm right portion having a rearward terminus, the forward portion of the swing arm having a forward surface and a rearward surface, with the rearward surface of the forward portion of the swing arm having a plurality of jet holes therein.

4. The pool water screen device as described in claim 3, with the device further comprising:

the fixed arm right portion having a down pipe hole and an associated down pipe rotatably coupled thereto, with the down pipe having a hollow tubular configuration with a passageway there through;

the swing arm left portion rearward terminus being rotatably coupled to the outward wall of the left side portion of the net holder, the swing arm right portion rearward terminus being rotatably coupled to the outward wall of the right side portion of the net holder; and the net screen having a forward edge with the net screen forming a rearwardly oriented recess.

5. The pool water screen device as described in claim 4, with the device further comprising:

the fixed arm left portion having a forward terminus, with the left portion forward terminus being closed, the right portion of the fixed arm having a forward terminus, with the right portion forward terminus being closed;

the net holder lower portion and the net holder right side portion and the net holder left side portion each having a generally C-shaped configuration with an outwardly disposed wall, the generally C-shaped configuration of the lower portion and the right side portion and the left side portion each having an inwardly oriented recess therein with the recess having a first width;

the swing arm left portion rearward terminus being closed; and the swing arm right portion rearward terminus being closed.

6. The pool water screen device as described in claim 5, with the device further comprising:

the fixed arm having a generally C-shaped configuration;

the net holder having a generally C-shaped configuration;

the swing arm having a generally C-shaped configuration;

the terminus of the left portion of the fixed arm being coupled to the lower section of the left side portion of the net holder, the terminus of the right portion of the fixed arm being coupled to the lower section of the right side portion of the net holder; and the swing arm left portion having a connecting tube hole and an associated connecting tube, the swing arm connecting tube operatively coupling the swing arm and the fixed arm thereby forming a continuous passageway between the fixed arm and the swing arm.

7. The pool water screen device as described in claim 6, with the device further comprising:

the fixed arm down pipe having a bleed-out valve operatively coupled thereto; and the swing arm connecting tube having a hollow tubular configuration.

8. The pool water screen device as described in claim 7, with the device further comprising:

a pair of similarly configured swing arm floats with each swing arm float being operatively coupled to the swing arm, with each swing arm float being located adjacent the plurality of swing arm jet holes;

a pair of fixed arm floats with each fixed arm float being operatively coupled to the fixed arm, with one fixed arm float being located on the right portion of the fixed arm and one fixed arm float being located on the left portion of the fixed arm;

a net holder float operatively coupled to the net holder;

the two net holder side portions being configured to be generally mirror images of each other; and the net screen forward edge being coupled to the net frame.

9. The pool water screen device as described in claim 8, with the device further comprising:

the fixed arm fabricated of a generally rigid material;

the net holder fabricated of a generally rigid material;

the swing arm fabricated of a generally rigid material;

the swing arm connecting tube being generally flexible;

the forward portion of the swing arm being rotatable between the right portion of the swing arm and the left portion of the swing arm;

the net frame being fabricated of a generally rigid material, the net frame having a gripping portion and the rearwardly oriented recess of the net screen being free, the net frame having a second width, with the first width being greater than the second width; and a liquid source, with the liquid source being coupled to the inflow pipe of the fixed arm.

10. A pool water screen device comprising, in combination:

a fixed arm having a hollow tubular configuration forming a fixed arm passageway through the fixed arm;

a swing arm being coupled to a net holder, the swing arm having a passageway therethrough;

a net coupled to the fixed arm;

the swing arm having jet holes therein;

the swing arm having at least one associated float;

the fixed arm having an associated inflow pipe, the fixed arm having an associated float, and the net having a grip.

* * * * *